United States Patent [19]

Yeagle

[11] 4,200,598

[45] Apr. 29, 1980

[54] ROTARY DRUM HUMIDIFIER

[75] Inventor: Richard J. Yeagle, Hartland, Mich.

[73] Assignee: General Filters, Inc., Novi, Mich.

[21] Appl. No.: 13,104

[22] Filed: Feb. 21, 1979

Related U.S. Application Data

[62] Division of Ser. No. 948,721, Oct. 5, 1978.

[51] Int. Cl.[2] ..... B01F 3/04

[52] U.S. Cl. ..... 261/92; 126/113; 137/577; 236/44 R; 236/44 C; 261/71; 261/129; 261/DIG. 15; 261/DIG. 34

[58] Field of Search ..... 261/71, 92, DIG. 15, 261/DIG. 34, DIG. 41, DIG. 46, 129; 126/113; 137/577; 251/349; 236/44 R, 44 C

[56] References Cited

U.S. PATENT DOCUMENTS

| | | | |
|---|---|---|---|
| 3,023,770 | 3/1962 | Godshalk | 137/577 X |
| 3,149,626 | 9/1964 | Wentling et al. | 261/DIG. 15 |
| 3,332,672 | 7/1967 | Schipper | 261/DIG. 34 |
| 3,441,256 | 4/1969 | Worsfold | 261/DIG. 15 |
| 3,472,496 | 10/1969 | Coleman et al. | 261/DIG. 15 |
| 3,491,746 | 1/1970 | Swimmer et al. | 261/DIG. 34 |
| 3,537,692 | 11/1970 | Vick | 261/DIG. 34 |
| 3,823,922 | 7/1974 | McElreath | 261/DIG. 15 |
| 3,856,279 | 12/1974 | Yeagle | 261/DIG. 15 |
| 3,951,625 | 4/1976 | Follette | 261/DIG. 34 |

FOREIGN PATENT DOCUMENTS

| | | | |
|---|---|---|---|
| 222321 | 6/1959 | Australia | 137/577 |

*Primary Examiner*—Richard L. Chiesa

*Attorney, Agent, or Firm*—Cullen, Sloman, Cantor, Grauer, Scott & Rutherford

[57] ABSTRACT

The rotary drum humidifier is mounted in an opening in the horizontal supply duct of a forced warm air furnace. The humidifier has a built-in manual humidity control wherein an adjustable thermostat is connected in series in the electrical humidifier motor circuit. The thermostat completes the electrical circuit on rising temperature in the duct and senses the peaks and valleys of the modulating duct temperature caused by the furnace heating cycle. When the control knob of the thermostat is set on "high", the humidifier will operate at a greater percentage of the furnace heating cycle and when set on "low" the humidifier will operate at a lesser percentage of the furnace heating cycle.

4 Claims, 11 Drawing Figures

ROTARY DRUM HUMIDIFIER

This is a division, of application Ser. No. 948,721, filed Oct. 5, 1978.

BACKGROUND OF THE PRESENT INVENTION

This invention generally relates to humidifiers, and more particularly relates to power humidifiers of the rotary drum type adapted to be inserted in the horizontal supply duct of any forced warm air furnace.

Heating systems for homes and other structures include several basic types of units which are classified either by the type of fuel used or by the type of heat distribution system used. Included in the latter category are steam heating, hot-water heating, and forced air-heating systems. With the advent of natural fuels and efficient burning systems forced-air heating systems have become extremely popular. The heat can be more readily distributed. Also unsightly heat exchanging units are eliminated. The burner itself is more efficient resulting in less dust and soot. In addition, forced-air heating systems lend themselves to combination with central air conditioning since only one set of ducts and outlets need be provided. A further advantage of forced warm air heating systems is the lack of extensive plumbing connections which require regular maintenance.

A disadvantage in forced warm air heating systems resides in the fact that the air in the enclosed area which is being heated is usually low in moisture content. A basic relationship exists between the temperature of the air and the moisture contained therein. Relative humidity is defined as the amount of moisture in the air as compared with the amount that the air could contain at the same temperature expressed as a percentage. It therefore follows, that if cool air, which is capable of containing only a fairly low amount of moisture, at a high relative humidity, is heated, the amount of moisture in the air remains exactly the same while the amount of moisture the air could contain rises. The result of this is an extremely low relative humidity. While unusually high relative humidity causes a great deal of discomfort, it is generally acknowledged that unusually low relative humidity can be equally as uncomfortable and can cause damage to both animate and inanimate objects. If the air is too dry, wood objects tend to dry out and contract with consequent damage thereto. Such wooden objects could include furniture as well as structural members of a building. As for the effects on the occupants of a building, various sinus tissues become dry and irritated. Further, static electricity easily builds up and creates extremely uncomfortable conditions.

These various ill effects associated with heating systems can be eliminated by providing a humidifier in the horizontal supply duct of any forced warm air furnace to raise the relative humidity of the air before passing it to the enclosed area which will be heated. Basically, such a humidifying system has a water reservoir, connected to a source of supply, and a rotating drum or evaporator located in the supply duct for increasing the contact area of the air with the water. The system includes means to provide a constant source of water in the unit. With such means must be associated means for controlling the delivery of water to the unit. Various delivery means have been used, but not all of them are able to compensate for fluctuations in evaporation rate due to air velocity and/or ambient relative humidity.

Also, depending on the hardness of the water in a particular area, a buildup of minerals in the reservoir can occur, thereby necessitating frequent cleaning and perhaps even repairs. Associated with the necessity to compensate for water hardness is the necessity to control the growth of algae in the reservoir.

Another disadvantage associated with the humidifiers of the prior art concerns the means for providing a large air-water contact area. Such means are often expensive and require frequent replacement due to clogging and other lessening of efficiency. Further, such means are often extremely inaccessible, thereby requiring the help of a serviceman to perform that operation.

SUMMARY OF THE PRESENT INVENTION

It is a feature of the present invention to provide a humidifier which is simple in construction, is easy to install, and is efficient to operate and to maintain.

Another feature of the present invention is to provide a humidifier which is hingedly mounted on the horizontal duct of a forced warm air furnace whereby the entire humidifier is permitted to swing downwardly. With such a construction, the humidifier and its component parts may be serviced, cleaned and maintained in a fast and efficient manner.

Still another feature of the present invention is to provide a combined tubular and flexible over-flow stem and quick drain tube assembly which serves when in one position as an over-flow stem or pipe to maintain the water in the reservoir at the proper level and which, when in a second position, drains all the water and mineral concentration from the reservoir.

A further feature of the invention is to maintain fresh water in the humidifier reservoir by providing a flexible funnel-like element for removing stale water and mineral deposits.

A still further feature of the present invention is to provide a novel rotor assembly for a humidifier which increases the contact area between the air and water and can be easily serviced and/or replaced. When mounted in the humidifier, the novel rotor assembly is both accessible and reusable after cleaning.

Another feature of the present invention is to provide a humidifier with a built-in manual humidity control. An adjustable thermostat is provided in the electrical humidifier motor circuit that completes the circuit on rising duct temperature. With such a construction, the adjustable thermostat senses the peaks and valleys of the modulating duct temperature caused by furnace heating cycle to obtain the desired and preselected level of humidifier output when the humidifier is operating.

DESCRIPTION OF A PREFERRED EMBODIMENT

Figure 4:
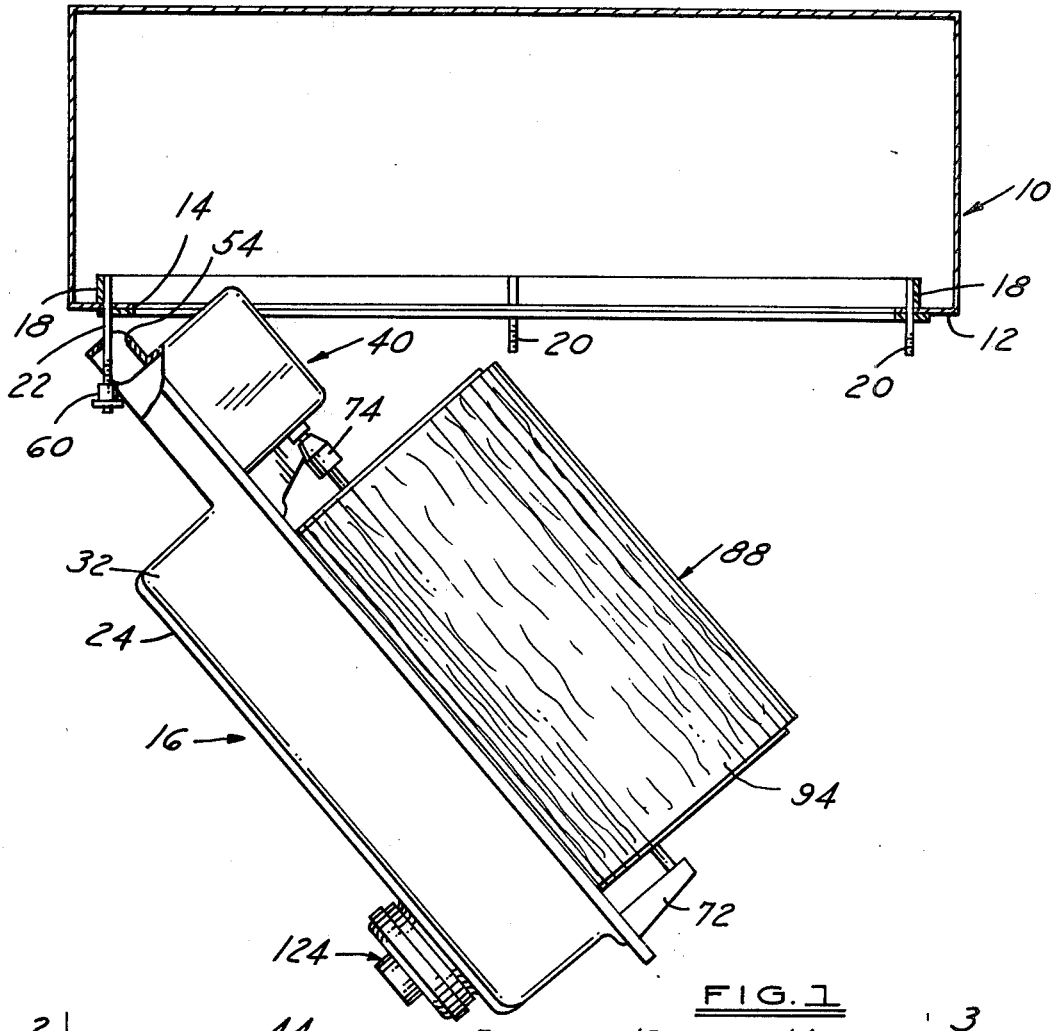
FIG. 4 is an elevation of the humidifier hingedly mounted on the horizontal supply duct of a forced warm air furnace and in a non-operative position for maintenance purposes.
Figure 5:
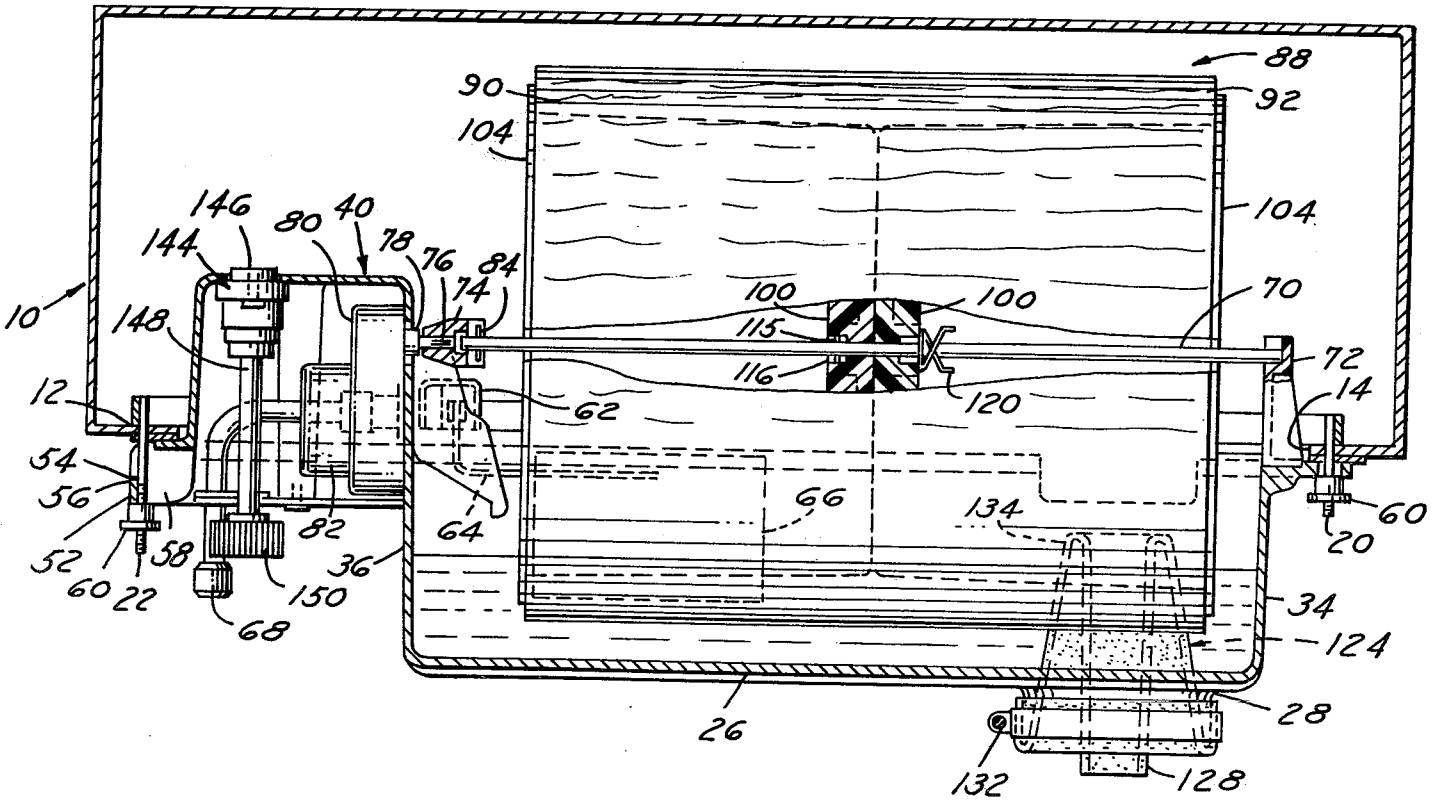
FIG. 5 is a transverse view, partly in section, showing the humidifier in an operative position in the duct.

The horizontal supply duct of a forced warm air furnace is designated by the numeral 10 in FIGS. 4 and 5. The duct 10 is of rectangular configuration and includes a bottom horizontal wall 12 and a generally rectangular opening 14 cut into the bottom horizontal wall 12 so that the power humidifier 16 may be installed in the opening 14 as in FIG. 5, with the humidifier 16 perpendicular to the air flow through the duct 10.

The opening 14 is provided in the bottom wall 12 of the warm air supply duct 10 at a position which is at least twenty-four inches from the vertical supply plenum, not shown. An appropriate template, not shown, may be used to mark the boundary of the opening 14 and to assist in marking areas for stud openings in the bottom wall 12. An annular mounting bracket 18 is placed inside the duct 10 and has six mounting studs 20 which extend downwardly through the stud openings provided in the wall 14. A pair of adjacent studs 22 have lengths greater than the other sutds 20 as shown in FIG. 4 and are designed to hold the motor end of the humidifier 16 as will subsequently be described.

Figure 6:
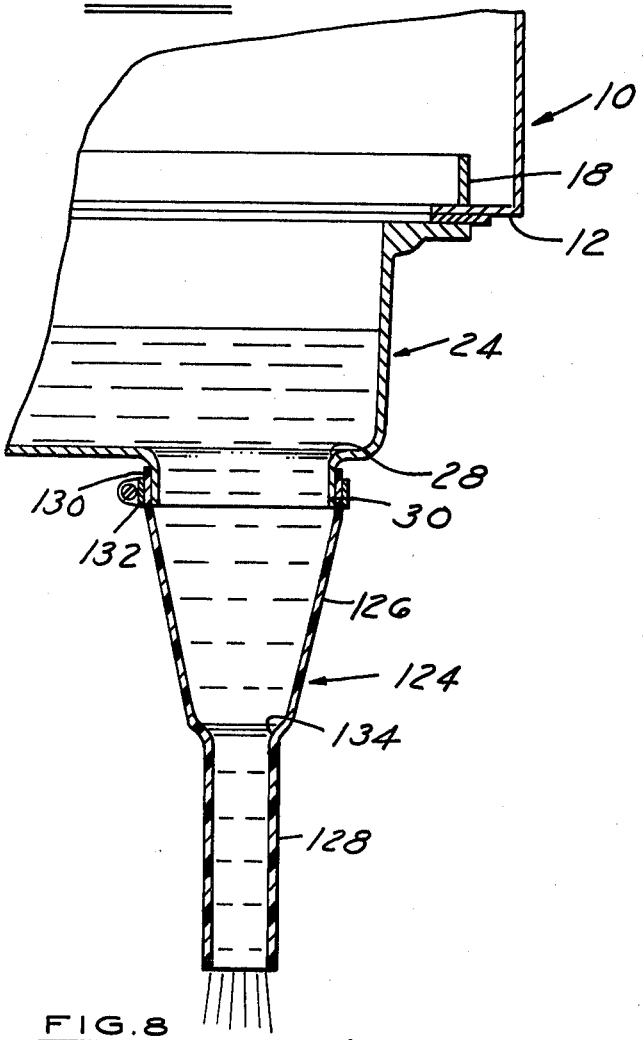
FIG. 6 is a fragmentary sectional view of the reservoir or water pan, with the combined stem and tube extending downwardly from the pan to drain the water therein.

The humidifier 16 has an upwardly open and unitary housing 24 in the form of a water pan or of a pan-like receptacle made from a light weight plastic material. The housing 24 includes a generally flat and rectangular bottom wall 26 having an opening 28 therein near one corner thereof which is surrounded by a downwardly extending rim 30 as best shown in FIG. 6. The housing 24 has a pair of upstanding side walls 32 which are parallel and are of generally equal height. Finally, the housing includes a first end wall 34 and a second end wall 36. The end walls 34 and 36 are parallel. Side walls 32 and end wall 34 are of the same height. End wall 36 has a greater height than the other side and end walls to form one side of the motor and gear housing 40.

The side walls 32, end wall 34 and the bottom portion of the motor and gear housing 40 are provided with outwardly extending flanges including side flanges 42 and 44, end flanges 46 and the flange 48 surrounding the motor housing. Flanges 42, 44, 46 and 48 form a generally continuous annular rim having a uniform elevation. Such flanges 42, 44 and 46 are provided with apertures 50 for receiving the studs 20 carried by mounting bracket 18. The flange 48 is provided with a downwardly extending elongated ledge 52 which is parallel to end wall 36. The ledge 52 has a pair of slots 54 which accommodate the pair of long studs 22. The inside surface 56 of ledge 52 adjacent each slot 54 is provided with a pair of ears 58 which together with the studs 22 and corresponding nuts form hinge means and assist in permitting the humidifier 16 to swing as shown in FIG. 4 as will be subsequently explained.

In installing the humidifier 16, the flange openings 50 and slots 54 are aligned with the studs 20 and 22 respectively and thereafter thumb nuts 60, one for each stud, are threaded on the studs 20 and 22 to urge and hold the flanges of the housing 24 against the duct wall 12 throughout 360°.

It should be appreciated that the two long studs 22 and corresponding nuts 60 cooperate with the two pairs of ears 58 and slots 54 located on the ledge 52 to form a hinge means which permits the humidifier 16 to swing as in FIG. 4 to permit cleaning, repairing and maintenance of same.

A float controlled valve construction 62 is conventional and has a float arm 64 and float 66. The valve 62 is connected by a conduit 68 to the water supply not shown. When the water in the pan or reservoir 24 falls below a predetermined level, the float 66 drops and the valve 62 opens to supply additional water to the water pan 24 as is well known in the art.

A rotor shaft 70 has one end rotatably mounted in a fixed and upstanding bracket 72 and the other end connected to an axially engaged coupling 74 which connects the rotor shaft 70 with a motor output shaft 76. The output shaft 76 is carried in a bearing 78 mounted in the end wall 36 as shown in FIG. 5. An electric drive motor 82 is located within housing 40 and contains a gear reduction 80 whereby the rotor shaft 70 is driven at about one revolution per minute. The shaft 70 is horizontal and is parallel to the side walls 32. The motor drive and coupling assembly may include a slip clutch as is well known in the art or the coupling 74 may be a direct fixed connection between the motor output shaft 76 and the rotor shaft 70. Shaft 70 has a non-circular axially slidably inserted end portion 84 for forming a drive connection to the coupling 74.

The rotor shaft 70 is part of a rotor assembly 88 that comprises spaced separate opposite end members 90 and 92 mounted on the shaft 70 and an annular water pick up sleeve or annulus 94 of flexible porous synthetic plastic material extending betweem the end members 90 and 92. The lower portion of the porous sleeve 94 passes through the water reservoir or pan 24 during the rotation of the rotor assembly 80 on the shaft 70 by the motor 82.

Figure 8:
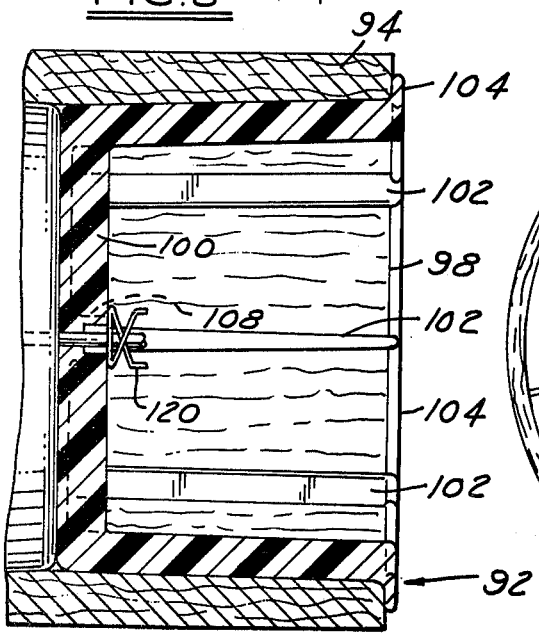
FIG. 8 is a sectional view of the rotary drum or rotor assembly taken on the line 8—8 of FIG. 7.

The end members 90, 92 are of generally identical construction and are disposed in longitudinally abutting relation on shaft 70. Each end member 90, 92 has an inner end 96 and an outer end 98 as shown in FIG. 8, with the inner ends being closed and the outer ends being opened. Each end member 90, 92 comprises a generally solid disc 100 at the closed inner end 96 which extends radially outwardly from shaft 70. The disc 100 is provided on one side and on the outer periphery thereof with a series of longitudinally extending circumferentially spaced ribs or fingers 102, spaced 45° apart. The ribs 102 are integral with the disc.

The ribs 102 are of equal length and of generally uniform rectangular cross-section. The ribs 102 extend from disc 100 at the closed and inner end to the opened and outer end. The outer ends of the ribs are integrally secured to an annular axially facing flange 104 which is located peripherally outwardly of the ribs 102 at the open end of the end member 90, 92 as best shown in FIGS. 7 and 8.

Figure 7:
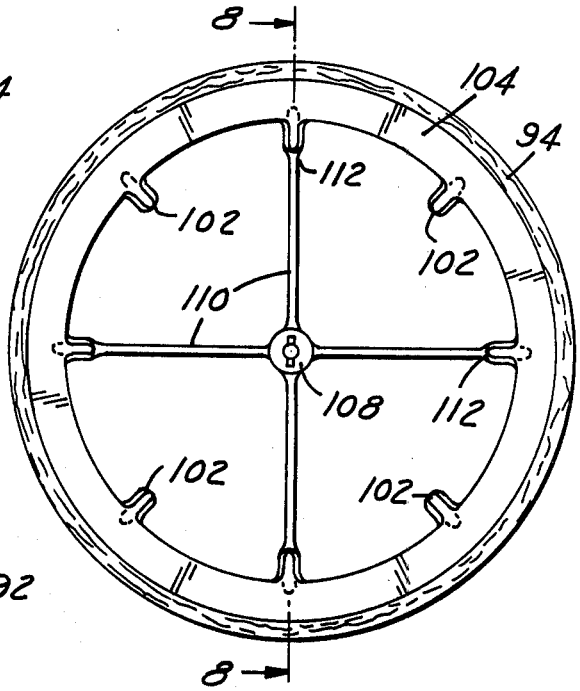
FIG. 7 is an end view of the rotary drum or rotor assembly.

Each disc 100 is flat and is provided on one side thereof with an integral centrally located hub 108 and is a plurality of integral elongated reinforcing elements 110 located 90° apart as shown in FIG. 7. Each element 110 extends from the inner surface 112 of one rib 102 to the hub 108. The reinforcing elements 110 intersect hub 108 located at the center of the disc 100 and through which the shaft 70 extends.

The end members 90, 92 are made from a hard synthetic plastic material such as General Electric NORYL. The ribs 102 and elements 110 each has a thickness of approximately 0.125".

The water pick up or evaporator sleeve 94 is made from a flexible porous synthetic material and surrounds the end members 90, 92, with the opposite ends of the sleeve 94 abutting the flanges 104 of the end members. With such a construction, the ribs 102 project longitudinally part way into the interior of the sleeve 94. The sleeve 94 is thus independently supported by the ribs 102. The outer peripheries of the ribs 102 on each of the end members 90, 92 have the same effective diameter and define smooth surface means which slidably receives the ends of the sleeve 94.

As shown in FIG. 5, the hub 108 of end member 90 has a key slot 116 which receives an enlarged non-circular fixed key 118 provided on shaft 70 to connect end member 90 nonrotatably to shaft 70 in the assembly. In assembly the rotor assembly 88, end member 90 is introduced onto the right hand end of shaft 70 (FIG. 5) and is slidably displaced along the shaft until key slot 116 of the hub 108 interfits with the key 118 on the shaft. This limits axial displacement of end member 90 along the shaft in that direction and also locks the end member 90 and shaft 70 for rotation together. Next the end member 92 is slid onto shaft 70 and is moved to the left as viewed in FIG. 5 to abut the disc 100 of the other end member 90. Thereafter a resilient sheet metal retainer clip 120 is placed on shaft 70 and urged into abutting relation with the hub 108 of end member 92 to hold the latter against axial displacement and to hold the end members 90, 92 in abutting relation.

Referring now to FIGS. 5 and 6, a combined tubular and flexible over-flow stem and quick drain tube assembly is designated by the numeral 124. The tube assembly 124, when extended in a drain position as shown in FIG. 6, is in the form of a wide mouth conical vessel or stem 126 terminating in a tube 128. The open end 130 of vessel 126 receives the pan rim 30. A clamp 132 removably secures the assembly 124 to the pan rim 30.

The assembly 124 has two positions, one position being with the stem or vessel 126 extending upwardly from the bottom wall 26 of the reservoir and surrounding the tube 128 as shown in FIG. 5 whereby excess water in the reservoir can over-flow the rim 134 of the stem 126 and escape to drain through the tube 128.

It is important that the reservoir be frequently drained to keep the water fresh and to reduce the mineral concentration in the water pan 24. This may be accomplished easily and rapidly by pulling the tube 128 downwardly from the position of FIG. 5 to the second position of FIG. 6 whereby the water and minerals drain through the extended vessel 126 and tube 128. An extra vinyl conduit of a sufficient length may be connected to tube 128 and run to a suitable drain connection, not shown. After the water has been drained, the drain assembly 124 is returned to the first position of FIG. 5 by inserting tube 128 in vessel 126 and urging same into the pan or reservoir to form the over-flow. The water is then replenished in the reservoir in the usual manner.

The over-flow stem and drain tube assembly 124 is in the form of a funnel-like element and is made from a flexible plastic material such as vinyl.

Figure 1:
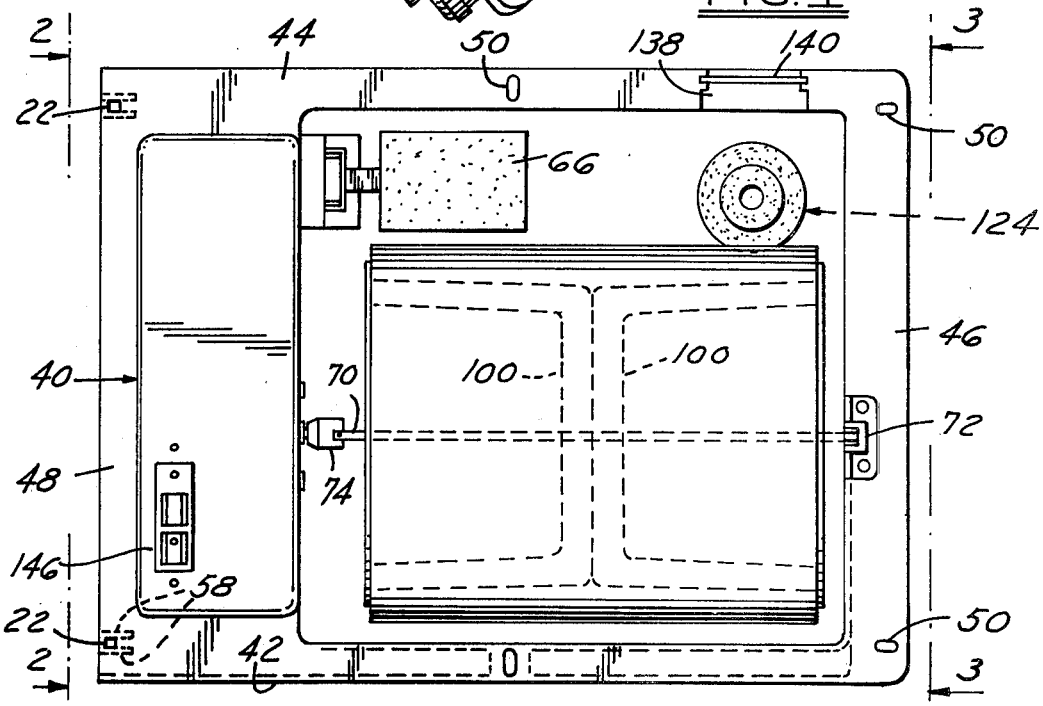
FIG. 1 is a top view of the humidifier.

The rim 44 (FIG. 1) is interrupted and is provided with a depression 138 in which is located a transparent window 140 through which a person can view the water level in the water pan 24 and the upper rim 134 of the assembly 124.

Figure 2:
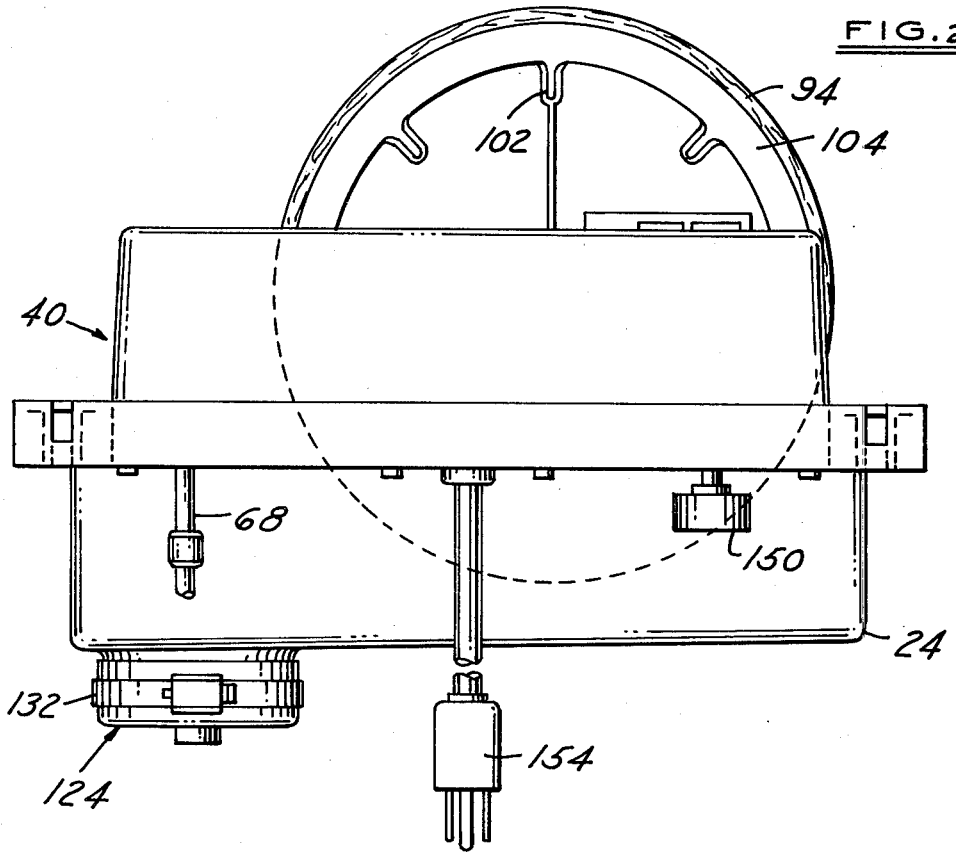
FIG. 2 is an end view of the humidifier looking in the direction of arrows 2—2 of FIG. 1.
Figure 3:
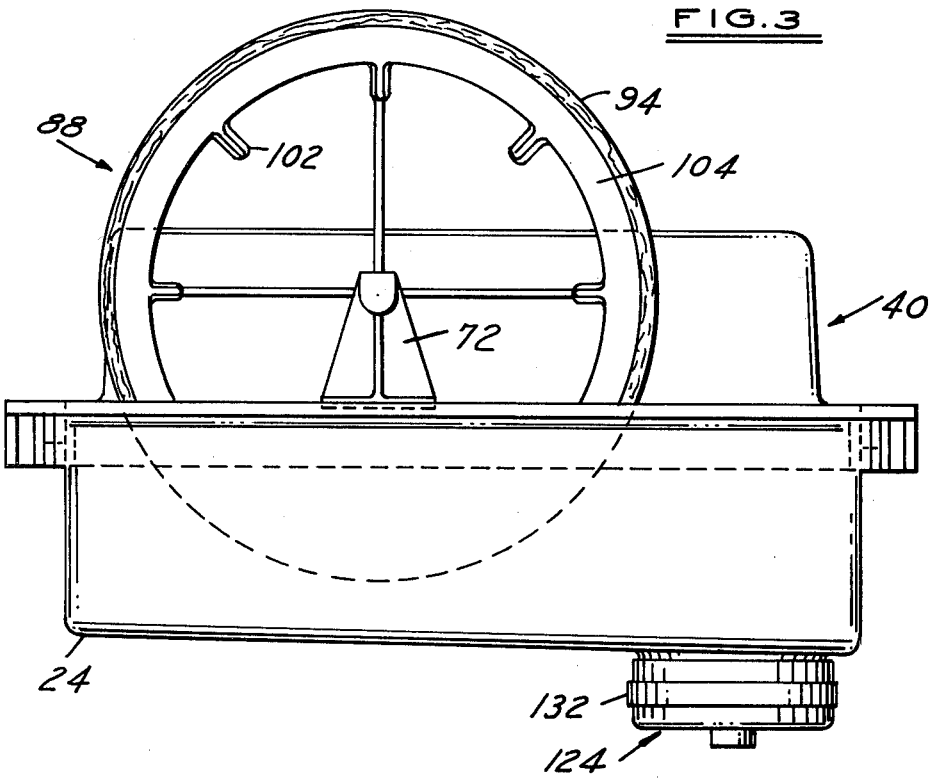
FIG. 3 is another end view of the humidifier looking in the direction of arrows 3—3 of FIG. 1.
Figure 9:
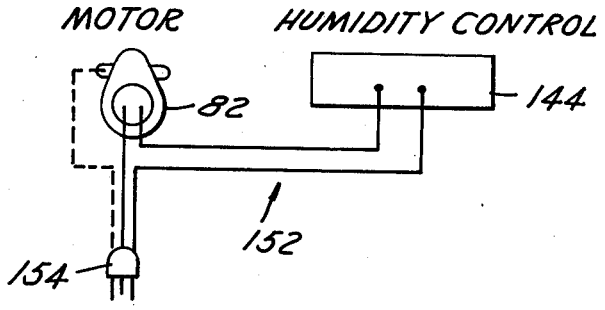
FIG. 9 is an electrical circuit diagram incorporating the humidifier motor and thermostat.

Also located in or carried by the top wall of the motor housing 40 is a humidity control assembly 144 in the form of an adjustable thermostat 146 which is secured to the upper end of a rotatable control rod 148 as shown in FIG. 5. The other or lower end of rod 148 has a knob 150 thereon to assist in rotating rod 148 and to thereby change the setting of the thermostat to either on, low, medium, high or off depending on the direction of rotation of the control rod 148. A scale, not shown, is provided on the bottom of the motor housing 40 and cooperates with a marker provided on knob 150. The adjustable thermostat 146 is connected in series in the humidifier motor circuit 152 as shown in FIG. 9. The circuit 153 includes an electrical cord having a three prong electrical plug 154 for connection to a suitable 115 volt power supply. The thermostat 146 completes the humidifier motor circuit 152 on rising duct temperature. The thermostat 146 senses the peaks and valleys of the modulating duct temperature caused by the furnace heating cycle. When the control is set on "HIGH", the humidifier will operate at a greater percentage of the furnace cycle; and when the control is set on "LOW", it will operate at a lesser percentage of the cycle. The humidifier does not require connection to the furnace blower circuit. The humidifier cord and plug 154 (FIG. 2) is inserted into a 115 volt electrical outlet that will remain on at all times.

In operating the humidifier, both the water supply and electrical power are turned on. Also the humidifier control 144 is set to the "ON" position. The humidifier motor 82 turns the rotor assembly 88 in the reservoir at one revolution per minute. The float valve 62 maintains the water level at approximately 1.5 inches. The "OFF" position of the humidity control corresponds to a trunk duct temperature of 160° F. and the "ON" position to a temperature of 70° F. When the humidity control 14 is set on "MEDIUM" (115° F.), the humidifier will run approximately 50% of the available furnace operating time.

Figure 11:
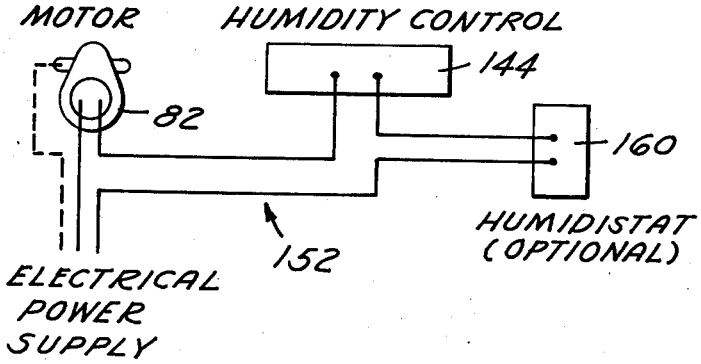
FIG. 11 is still another electrical circuit diagram including an optional humidistat in series with the humidifier motor and the thermostat.

As an optional accessory, a wall or duct mounted humidistat 160 may be incorporated in the humidifier motor circuit 152 as shown in FIG. 11. A humidistat may be required on heat pump systems used in warm air heating systems.

Figure 10:
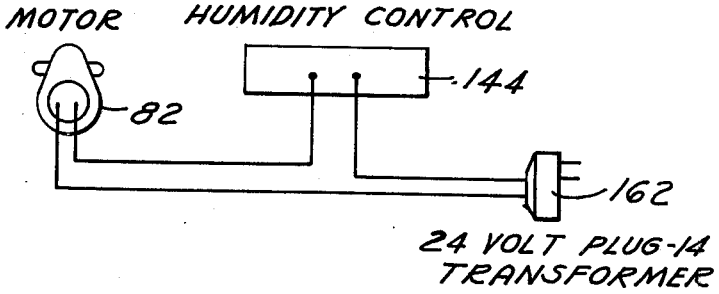
FIG. 10 is another electrical circuit diagram including the humidifier motor, thermostat and transformer.

As an optional circuit, the motor 82 and adjustable thermostat assembly 144 are connected to a 24 volt plug-in transformer 162 (FIG. 10) which is inserted into a 115 volt electrical outlet that will remain on at all times.

The operating principle of the power humidifier 16 is based on the most efficient and economical method of evaporating moisture to the air. The heat necessary for evaporation is provided by the furnace. Thus, the humidifier 16 is located in the horizontal supply duct 10 of the forced warm air furnace as mentioned previously. Water is supplied to the humidifier 16 by the float valve 62 which maintains a constant water level in the water pan 24. The evaporator means or rotor assembly 88 is driven by the gear motor 82 and rotates same in the reservoir of water as shown best in FIG. 5. The porous evaporator means 88 is rotated at one revolution per minute and is wetted by the water in the reservoir. The air to be himidified in the supply duct passes transversely through the rotor assembly 88 perpendicular to the plane of FIG. 5. The humidifier can be installed for longitudinal flow past the rotating drum, with reduced evaporative output. Such is recommended when the ducts are less than 16" wide.

In humidifier 16 the manually adjustable thermostat 146 completes the humidifier motor circuit 152 on rising duct temperature. The thermostat 146 senses the peaks and valleys of the modulating duct temperature in duct 10 caused by the furnace heating cycle as described previously.

When the humidifier 16 is operating no adjustment is necessary other than setting the humidity control 144 or the humidistat 160 to obtain the desired level of humidity. If the humidistat 160 is used, the built-in humidity control 144 is set at the "ON" position and thereafter the humidistat 160 is set in accordance with the recommended settings. The humidity control 144 is set to the lowest setting when the home is left unattended for extended periods of time. It is recommended that the "MEDIUM" position be used on the humidity control and that adjustments be made when operational experience requires. If the furnace is used for summer cooling or ventilation, the water and electrical supply to the humidifier 16 are turned off.

As mentioned previously, the power humidifier 16 is of the evaporative type which removes all the minerals from the water as the water evaporates into the air. The minerals are retained in the evaporator sleeve 94 and in the water pan 24 and are not blown into the air stream to collect in the living area. As mentioned previously, cleaning will be required on a periodic basis. As an example, the humidifier 16 should be cleaned every two months and more frequently in the hard water areas.

Thus, power humidifier 16 has many important features which provides for efficiency of operation, ease of maintenance of the humidifier, and many others as noted previously. The power humidifier 16 has a manually operated humidity control; a quick drain assembly for facilitating the draining of the humidifier; and a built-in hinge construction which permits the entire humidifier to swing out of the duct into an open position for making routine maintenance fast and easy.

What is claimed is:

1. A power humidifier having an on-off cycle and adapted to operate with a furnace which generates a time-temperature curve during its heating cycle, with the temperature capable of being plotted on the ordinate of a graph and the time capable of being plotted on the abscissa of the graph to form the curve which is generally sloped upward during the furnace burner-blower phase and is generally sloped downward during the cool down phase, said humidifier comprising a housing, evaporator means mounted in the housing, means for supplying water to said evaporator means to humidify the air passing through said evaporator means, an electrical circuit for the power humidifier including an adjustable thermostat interposed in said electrical circuit and effective to move the on-off cycle of the humidifier up or down the ordinate of the curve generated by the furnace heating cycle, said adjustable thermostat having a manually operated control knob for selecting on and off positions and low, medium and high humidity settings for said thermostat, said thermostat being adapted to control and to provide an adjustable humidifier daily evaporative output depending on the setting of the thermostat, said adjustable thermostat turning the humidifier on at the start of a furnace heating cycle and turning the humidifier off at the end of a furnace heating cycle, said adjustable thermostat completing the electrical circuit on rising temperature and sensing the peaks and valleys of the modulating temperature caused by the furnace heating cycle, the operating time of the humidifier as determined by the setting of said adjustable thermostat being the part of the abscissa below and within the time-temperature curve.

2. A power humidifier having an on-off cycle and a manually operated temperature responsive humidity control, said humidifier adapted to operate with a furnace which generates a time-temperature curve during its heating cycle, with the temperature plotted on the ordinate of the graph and the time plotted on the abscissa of the graph, with the power humidifier adapted for installation on the horizontal supply duct of a forced warm air furnace which has a heating cycle which results in modulating temperatures in the supply duct, said humidifier comprising a housing having a water reservoir and means for maintaining the water at a substantially constant level therein, a porous evaporator means rotatably mounted in said housing and adapted to be wetted by the water in said reservoir, said evaporator means comprising a generally cylindrical porous drum through which air to be humidified in the supply duct passes therethrough, a horizontally disposed drive shaft on which said drum is coaxially secured for rotation therewith, an electrical humidifier motor circuit including motor means carried by said housing and coupled to an end of said drive shaft for rotating said drum at a predetermined speed, an adjustable thermostat interposed in said electrical humidifier motor circuit and effective to move the on-off cycle of the humidifier up or down the ordinate of the curve generated by the furnace heating cycle, said thermostat having a manually operated control knob for selecting on and off positions and low, medium and high humidity settings for said thermostat, said thermostat being adapted to control and to provide an adjustable humidifier daily evaporative output depending on the setting thereof, said adjustable humidifier completing the humidifier motor circuit on rising duct temperature and sensing the peaks and valleys of the modulating duct temperature caused by the furnace heating cycle, the operating time of the humidifier as determined by the setting of said adjustable thermostat being the part of the abscissa below and within the time-temperature curve.

3. The power humidifier defined in claim 2 wherein a mounting bracket is adapted to be located inside of the opening in the horizontal supply duct and with the humidifier mounted outside of and over the opening, said mounting bracket being of annular configuration to surround the opening and having a plurality of spaced apart mounting studs extending through holes provided in the wall and surrounding the opening, said housing having a bottom wall and upstanding side walls provided with horizontally extending mounting flanges having apertures for receiving said studs, hinge means along one flange of said housing through which a pair of adjacent studs extends, and nuts threadedly secured to said studs for holding said flanges against the wall of the furnace or duct, with the nuts for said pair of adjacent studs engaging the bottom of said hinge means, said one flange having a ledge perpendicular thereto, said ledge being provided with a pair of spaced apart slots to accommodate said pair of adjacent studs, the studs of said pair of adjacent studs each has a length greater than the height of said ledge, said ledge having two pairs of spaced apart ears which form said hinge means, the ears of each pair being located on opposite sides of one of said slots, said housing being mounted for swinging movement away from the opening for servicing the humidifier by unfastening and removing the nuts except for the pair of nuts adjacent said hinge means.

4. The power humidifier defined in claim 2 wherein said housing has a bottom wall having an opening therein terminating in a downwardly extending annular rim, a manually operated combined tubular and flexible non-metallic over-flow stem and quick drain tube assembly in the form of a wide mouthed generally conically shaped vessel which terminates in a tube, with the wide mouth end of said vessel receiving said rim, means securing the vessel of said combined over-flow stem and drain tube assembly to said rim, said assembly having two positions, one position being with the tube telescopically located within said vessel and forming said over-flow stem, with said assembly located within said reservoir and extending upwardly from the bottom wall of said reservoir whereby excess water in said reservoir can over-flow said stem, and a second position being where the vessel and tube are located outside of said reservoir and extend downwardly away from the bottom wall of the reservoir to permit the water in the reservoir to drain through said vessel and tube.

* * * * *